US006533023B2

(12) United States Patent
Fukase et al.

(10) Patent No.: US 6,533,023 B2
(45) Date of Patent: Mar. 18, 2003

(54) FEEDING STRIP MATERIAL

(75) Inventors: Hisahiko Fukase, Tokyo (JP); Hiroaki Kuwano, Yokosuka (JP); Heiji Kato, Yokosuka (JP)

(73) Assignee: Castrip LLC, Charlotte, NC (US)

( * ) Notice: Subject to any disclaimer, the term of this patent is extended or adjusted under 35 U.S.C. 154(b) by 0 days.

(21) Appl. No.: 09/894,603

(22) Filed: Jun. 28, 2001

(65) Prior Publication Data

US 2002/0038696 A1 Apr. 4, 2002

(30) Foreign Application Priority Data

Jun. 30, 2000 (AU) ..... PQ8489

(51) Int. Cl.[7] ..... B22D 11/12
(52) U.S. Cl. ..... 164/442; 164/448; 164/444
(58) Field of Search ..... 164/444, 442, 164/443, 448

(56) References Cited

U.S. PATENT DOCUMENTS 4,442,883 A * 4/1984 Yamakami et al. ..... 164/448
5,209,283 A * 5/1993 Miltzow et al. ..... 164/448
5,638,891 A * 6/1997 Fukase et al. ..... 164/448
5,887,644 A * 3/1999 Akiyoshi et al. ..... 164/428
5,996,680 A * 12/1999 Fukase et al. ..... 164/428
6,059,013 A 5/2000 Krume
6,241,002 B1 * 6/2001 Russel et al. ..... 164/428

FOREIGN PATENT DOCUMENTS

| | | |
|---|---|---|
| DE | 27 07 907 | 8/1977 |
| JP | 88-210832/30 | 6/1998 |
| JP | 98-460943/40 | 7/1998 |
| RU | 2000-645835/62 | 5/2000 |
| WO | WO 93/19874 | 10/1993 |

* cited by examiner

*Primary Examiner*—M. Alexandra Elve
*Assistant Examiner*—Len Tran
(74) *Attorney, Agent, or Firm*—Barnes & Thornburg

(57) ABSTRACT

A pinch roll assembly that may be used for feeding hot metal strip comprises a pair of parallel pinch rolls. At least one of the rolls comprises a copper or copper alloy tube providing the external peripheral roll surface and internal water cooling passages to cool the cylindrical tube by flowing water through the passages. The copper or copper alloy tube is fitted to a cylindrical arbor formed with end shafts for mounting the roll in journal bearings. Shaft is provided with a rotary drive coupling and shaft is fitted with a rotary water coupling for flow of cooling water to the water flow passages.

13 Claims, 4 Drawing Sheets

FEEDING STRIP MATERIAL

This application claims priority to and the benefit of Australian Provisional Patent Application Number PQ8489, which was filed in Australia on Jun. 30, 2000.

TECHNICAL FIELD

This invention relates to a pinch roll assembly for feeding strip material that is particularly useful at high temperatures where the strip cannot be quenched during feeding. It has application in feeding hot metal strip produced from a continuous caster such as a twin roll caster.

In a twin roll caster, molten metal is introduced between a pair of contra-rotated horizontal casting rolls. The casting rolls are cooled so that metal shells solidify on the moving roll surfaces and are brought together at the nip between the casting rolls to produce a solidified strip product delivered downwardly from the nip between the rolls. The term "nip" is used herein to refer to the general region at which the rolls are closest together. The molten metal may be poured from a ladle into a smaller vessel or series of vessels from where the molten metal flows through a metal delivery nozzle forming a casting pool of molten metal supported on the casting surfaces of the rolls immediately above the nip. This casting pool may be confined between side plates or dams held in sliding engagement with the ends of the rolls.

The hot strip leaving the caster may be passed to a coiler on which the strip is wound into a coil. Between the caster and the coiler the strip may be subjected to in-line treatment such as a controlled temperature reduction, reduction rolling, full heat treatment or a combination of such treatment steps. The coiler and any in-line treatment apparatus generally applies substantial tension to the strip. Moreover, differences between the casting speed of the twin roll caster and speed of subsequent in-line processing and coiling must be accommodated. Substantial differences in those speeds may develop particularly during initial start-up and until steady state casting speed is achieved. To accommodate these requirements, the hot strip leaving the caster may be allowed to hang unhindered in a loop form and then passed through one or more sets of pinch rolls into a tensioned part of the line in which the strip may be subjected to further processing before coiling. The pinch rolls provide resistance to the tension generated by the down-line equipment and are also intended to feed the strip into the down-line equipment.

A twin roll strip casting line of this kind is disclosed in U.S. Pat. No. 5,503,217 assigned to Davy McKee (Sheffield) Limited. In this casting line the hot metal strip hangs unhindered in a loop before passing to a first set of pinch rolls which feed the strip through a temperature control zone. After passing through further sets of pinch rolls, the strip then proceeds to a coiler. The strip may optionally be hot rolled by inclusion of a rolling mill between the subsequent sets of pinch rolls. However, as noted in U.S. Pat. No. 5,503,217, strip passing from zero tension to a tensioned part of a processing line can wander from side to side. This wandering of the strip may be overcome by providing a first set of pinch rolls to steer the metal strip from the loop into the tensioned part of the processing line.

This first set of pinch rolls must be capable of gripping and feeding the hot metal strip very soon after it has solidified. Particularly when casting ferrous metal strip, the strip temperature at this position in the line is very high, more than 1000° C. and typically of the order of 1200° C., and the strip itself will be very soft and easily damaged. Furthermore, the strip at this location is enclosed in a reducing atmosphere where quench water cannot be applied to the strip as it is fed through the pinch rolls. It has been found that if conventional steel pinch rolls are used for feeding the hot strip at this position localized defects are imprinted in the surface of the strip that appear in the finished strip. Under these conditions, the imprinted defects are generally due to the generation of hot spots on the steel pinch rolls with resultant localized thermal expansion at those regions and production of projections which imprint depressions in the strip surface. When rolling steel strip in this process, scale from the strip surface can stick to the high spots on the pinch rolls. Accordingly, any high spots due to localized thermal expansion can rapidly be built up to substantial projections which can produce severe imprint defects in the strip.

DISCLOSURE OF THE INVENTION

The present invention enables this problem to be alleviated by providing a pinch roll assembly that reduces generation of high spots and reduces the formation of projections on the roll surfaces due to localized thermal expansion. According to the invention, there is provided a pinch roll assembly for feeding hot metal strip that is comprised of a pair of parallel pinch rolls to receive the strip in the nip between the pinch rolls, and drive means to drive the pinch rolls so as to feed the strip between the pinch rolls. At least one of the pinch rolls, and may be both, is comprised of a pair of end support shafts, a cylindrical tube of copper or copper alloy extending between the support shafts, and cooling water passages to enable cooling water to flow internally of the roll to cool the sleeve. The cylindrical tube provides an external peripheral roll surface of at least 300 mm in diameter, and together with the cooling water passages, and resulting cooling water flow, are sufficient to provide small displacement of the strip at the nip of the pinch rolls.

The end shafts are connected to a cylindrical arbour (i.e., a solid or hollow cylindrical frame) to which the copper or copper alloy tube is fitted as an external sleeve. In this embodiment, the water flow passages may be confined to the cylindrical arbour. More specifically, the cooling water passages may include longitudinal passages in the cylindrical arbour spaced, typically evenly, circumferentially around the arbour adjacent the sleeve.

Alternatively, the roll may be of an arbourless construction in which the end shafts have end formations connected to respective ends of the cylindrical tube of copper or copper alloy. In this embodiment, the water flow passages may deliver cooling water to the interior of the cylindrical tube or the passages may extend longitudinally through the tube.

The diameter of the external peripheral roll surface of the pinch roll is may be at least 500 mm. Alternatively, the diameter of the external peripheral roll surface of the roll may satisfy the following equation:

$$D > 2\sigma_y^{-2} \cdot q \frac{1}{\pi\left(\frac{1-v_1^2}{E_1} + \frac{1-v_2^2}{E_2}\right)} \tag{1}$$

where q: Load per unit width

D: Pinch roll diameter $v_1$, $v_2$: Poisson's ratio of roll and strip $E_1$, $E_2$: Young's modulus of roll and strip $\sigma_y$:Minimum yield stress The invention may be used with apparatus for continuously casting metal strip comprising a pair of casting rolls forming a nip between them, a metal delivery means for delivery of molten metal into the nip between the casting rolls to form a casting pool of molten metal supported on the casting roll surfaces immediately above the nip, roll drive means to drive the casting rolls in counter rotational directions to produce a solidified strip of metal delivered downwardly from the nip, and strip feed means disposed generally to one side of the caster to receive strip from the caster and feed it away from the caster. The pinch roll assembly of the present invention may be used to apply tension to the hot strip shortly after casting at high temperature above 1000° C. in an enclosed chamber with a reducing atmosphere.

The pinch roll assembly mean comprises a pair of parallel pinch rolls to receive the strip in the nip between the rolls, and drive means to drive the roll so as to feed the strip between the pinch rolls. At least one and usually both of the pinch rolls comprises a pair of end support shafts, a cylindrical tube of copper or copper alloy extending between the support shafts to provide an external peripheral roll surface, and cooling water passages internally to the roll to cool the tube by flow of cooling water. The pinch roll assembly may be a pair of end support shafts, a cylindrical arbour to which the copper or copper alloy tube is fitted as an external sleeve or an arbourless cylindrical sleeve of copper or copper alloy extending between the support shafts to provide the external peripheral roll surface. The external diameter of the peripheral roll surface is more than 300 mm, and together with the cooling water passages, and resulting cooling water flow, enables a small displacement of the strip at the nip of the pinch rolls.

BRIEF DESCRIPTION OF THE DRAWINGS

Particular embodiments of the invention may be more fully described, in an application with a strip caster, with reference to the accompanying drawings in which.

DETAILED DESCRIPTION OF THE DRAWINGS

Figure 1:
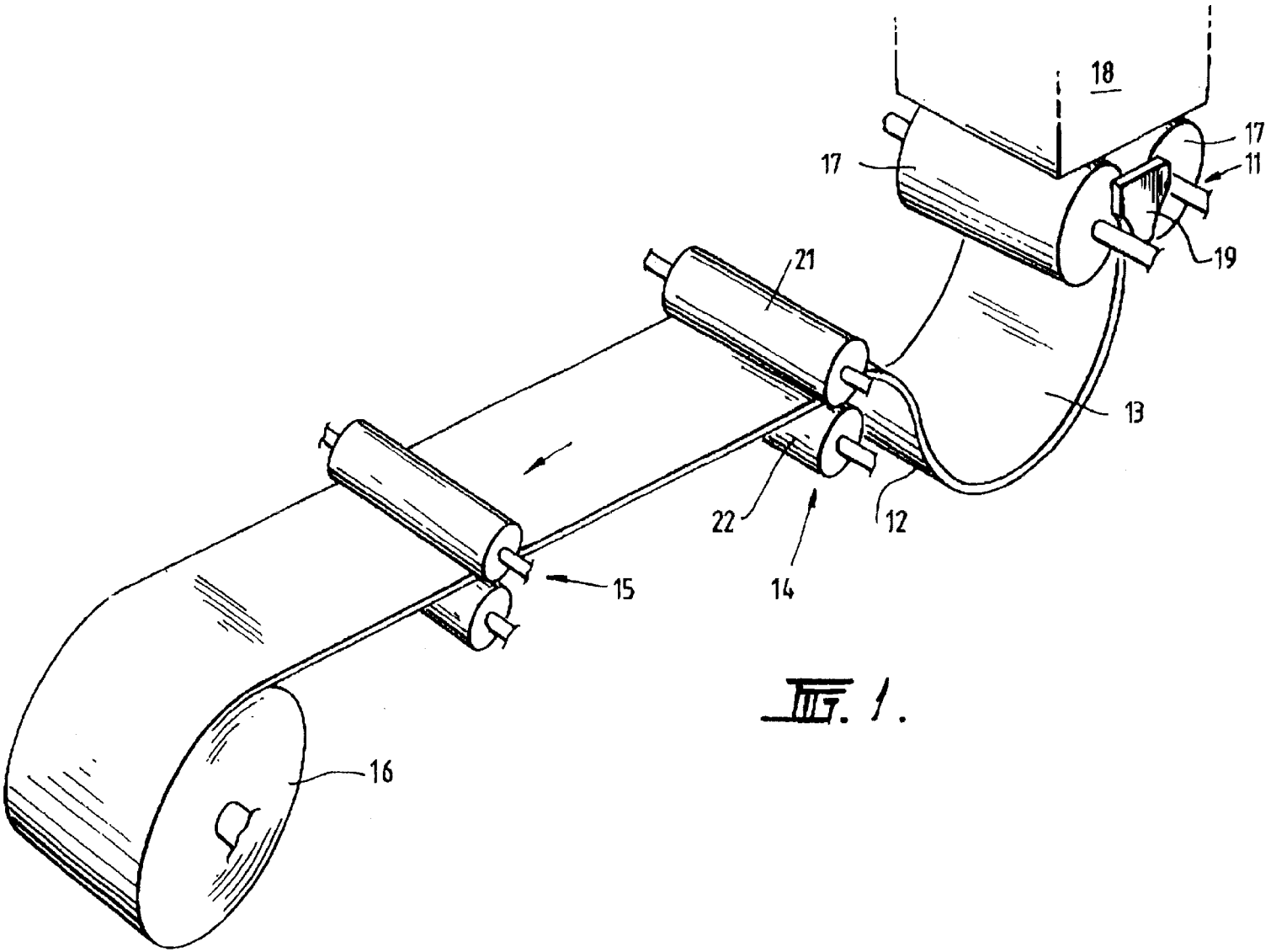
FIG. 1 diagrammatically illustrates a strip casting installation with an embodiment of the pinch roll assembly of the present invention.

The strip casting installation illustrated in FIG. 1 comprises a twin roll caster denoted generally as 11 which produces a cast steel strip 12 which hangs in a loop 13 between the caster 11 and a first pinch roll assembly 14, which takes up the strip 12 and feeds it forwardly through a second pinch roll assembly 15 to a coiler 16. Between the pinch roll assemblies 14 and 15 the strip 12 may be hot rolled by passing through a hot rolling mill (not shown) and it may pass over a runout table on which it may be force cooled by water jets before proceeding to the coiler 16.

Twin roll caster 11 comprises a pair of casting rolls 17 to which molten metal is supplied through a header box 18 to form a casting pool resting on the casting surfaces of the rolls above the nip between the casting rolls 17 and confined at the ends of the rolls by side dam plates 19. Casting rolls 17 are internally water-cooled. Casting rolls 17 are driven so as to be contra-rotated such that metal shells solidifying on the peripheral surfaces of the casting rolls are brought together at the nip between them to produce the solidified strip 12, which is fed downwardly from the nip by the rotation of the casting rolls.

On leaving caster 11, strip 12 hangs in an unhindered loop 13 from which it passes through the first pinch roll assembly 14 which comprises a pair of pinch rolls 21 and 22. The pinch rolls 21 and 22 feed the strip 12 into the down-line equipment and provide resistance to the tension generated by that equipment, while allowing the strip 12 upstream from the pinch rolls 21 and 22 to hang in the unhindered loop without substantial imposed tension.

When casting steel strip with the caster 11, the strip 12 entering the first pinch roll assembly 14 will generally be at a temperature of the order of 1200° C., and the strip 12 may have a thin layer of surface scale even when scale suppression is employed, such as by an inert gas enclosure. It has been found that if conventional steel pinch rolls are used in place of the pinch rolls 21 and 22 of the first pinch roll assembly 14 the external peripheral cylindrical surfaces 32 of the pinch rolls 21 and 22 develop high spots which impose imprint defects in the surface of the strip 12. These high spots correspond with thermal hot spots which develop because of heating of the rolls 21 and 22 as they contact the hot strip 12. The hot spots cause local thermal expansion which generate high spots that in turn attract build up of scale deposits to generate quite substantial localized projections in the roll surfaces.

Figure 2:
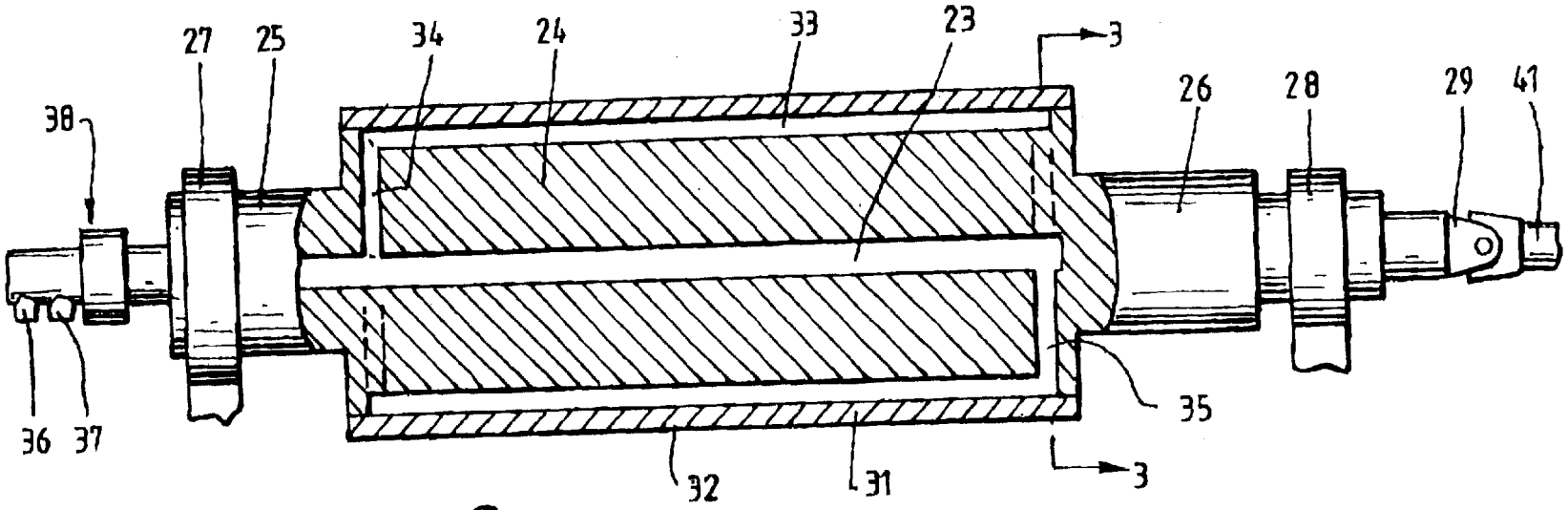
FIG. 2 illustrates a pinch roll assembly in accordance with an embodiment of the present invention.
Figure 3:
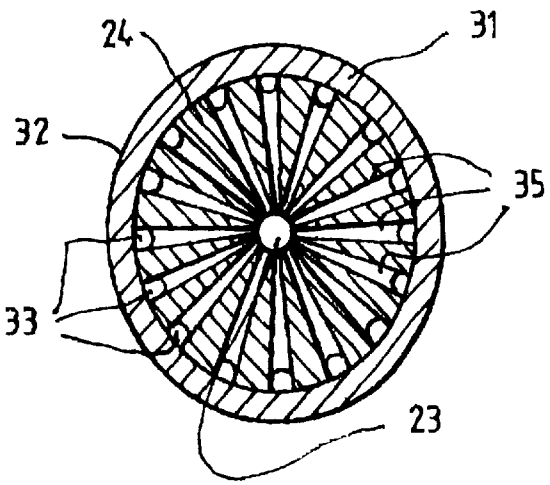
FIG. 3 is a transverse cross-section on the line 3—3 through the pinch roll assembly of FIG. 2.

This problem is addressed by the use of the pinch roll assembly illustrated in FIGS. 2 and 3. The pinch roll assembly comprises a cylindrical arbour 24, with end shafts 25 and 26 supporting the arbour 24 for rotation in journal bearings 27 and 28. The cylindrical arbour 24 and support shafts 25 and 26 may be formed of stainless steel. The shaft 26 is provided with a transmission coupling 29 for connection with a drive spindle to rotate the pinch rolls 21 and 22.

A cylindrical copper or copper alloy sleeve or tube 31 is tightly fitted over the arbour 24 to provide the external peripheral roll surface 32 of the pinch roll. The arbour 24 of the pinch roll is provided with cooling water flow passages 23 to provide continuous cooling of the sleeve or tube 31. The water flow passages 23 are comprised of a series of longitudinal passages 33 spaced circumferentially about the outer part of cylindrical arbour 24 adjacent the cylindrical sleeve 31, and radial passages 34 and 35 at the ends of the arbour 24 which connect with central inlet and outlet 36 and 37, which fluidly communicate through rotary water coupling 38 on support shaft 25 with passages 23.

Figure 4:
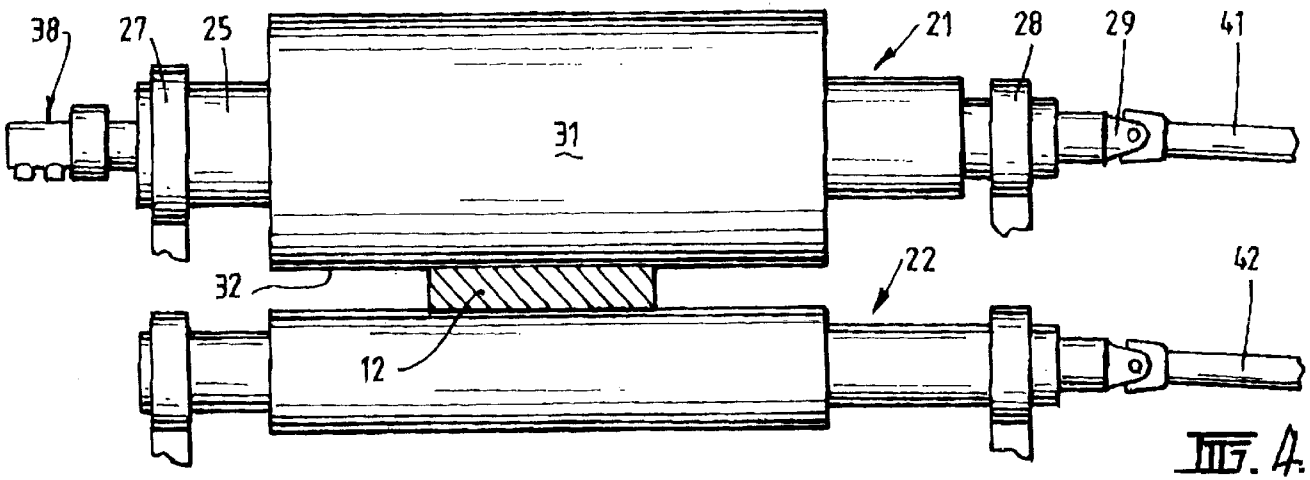
FIG. 4 illustrates how a pinch roll assembly of the kind illustrated in FIG. 2 operated in combination with a conventional steel roll.

FIG. 4 illustrates one arrangement for the pinch roll assembly 14 in which one of the pinch rolls 21 has the construction as illustrated in FIGS. 2 and 3, whereas the other pinch roll 22 is a conventional steel roll. The pinch rolls 21 and 22 are couple to respective rotary drive spindles 41 and 42.

Figure 5:
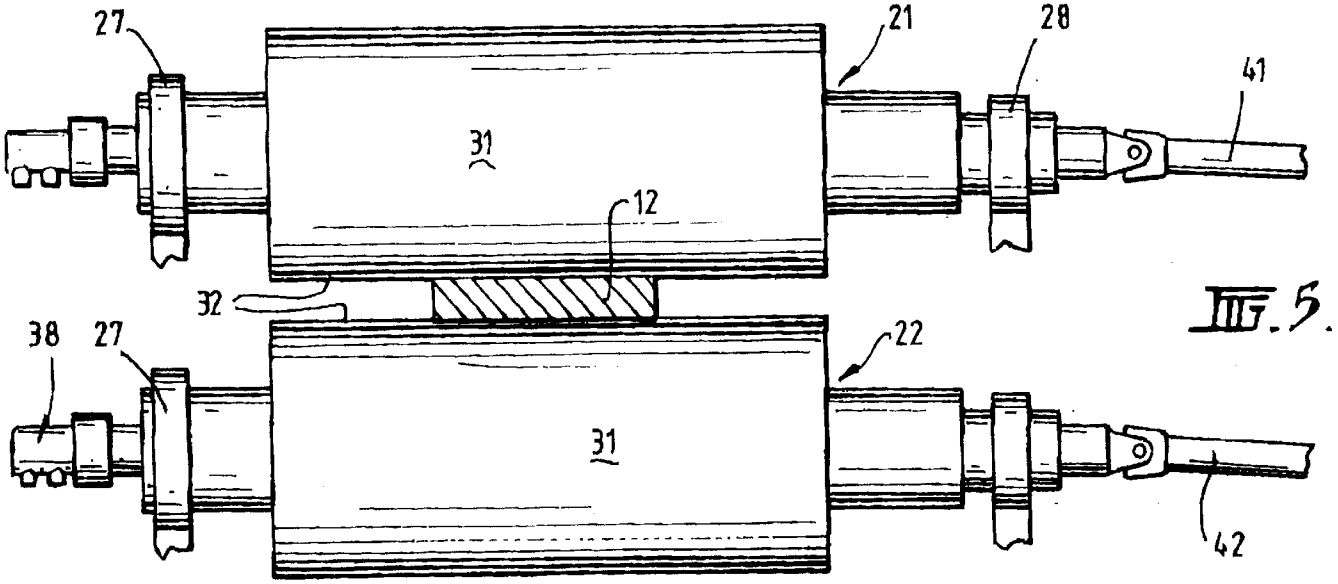
FIG. 5 illustrates a pinch roll assembly where each one of the pair of pinch rolls are constructed in the manner illustrated in FIG. 2.

FIG. 5 illustrates an alternative embodiment in accordance with the invention in which both of the pinch rolls 21 and 22 are constructed in the manner illustrated in FIGS. 2 and 3. Both pinch rolls 21 and 22 in this embodiment have external cylindrical sleeves or tubes 31, and internal water flow passages 23A for cooling of those sleeves.

Because of the high thermal conductivity of copper, the cylindrical sleeves or tubes 31 are much less prone to the development of hot spots, since the heat conducted from the hot strip is conducted much more evenly through the sleeves or tube 31 than through a solid steel body. Accordingly, any thermal expansion is much less localized and tends to spread more evenly over the external peripheral roll surface 32 of the pinch roll. At the same time, the heat is continuously extracted from the cylindrical sleeve or tube 31 through the internal water cooling flows through passages 23A, and dramatically reduces any tendency for hot spots to develop. Pinch rolls 21 and 22 of this construction can dramatically reduce the incidence of imprint defects in the surface of the strip 12.

Figure 6:
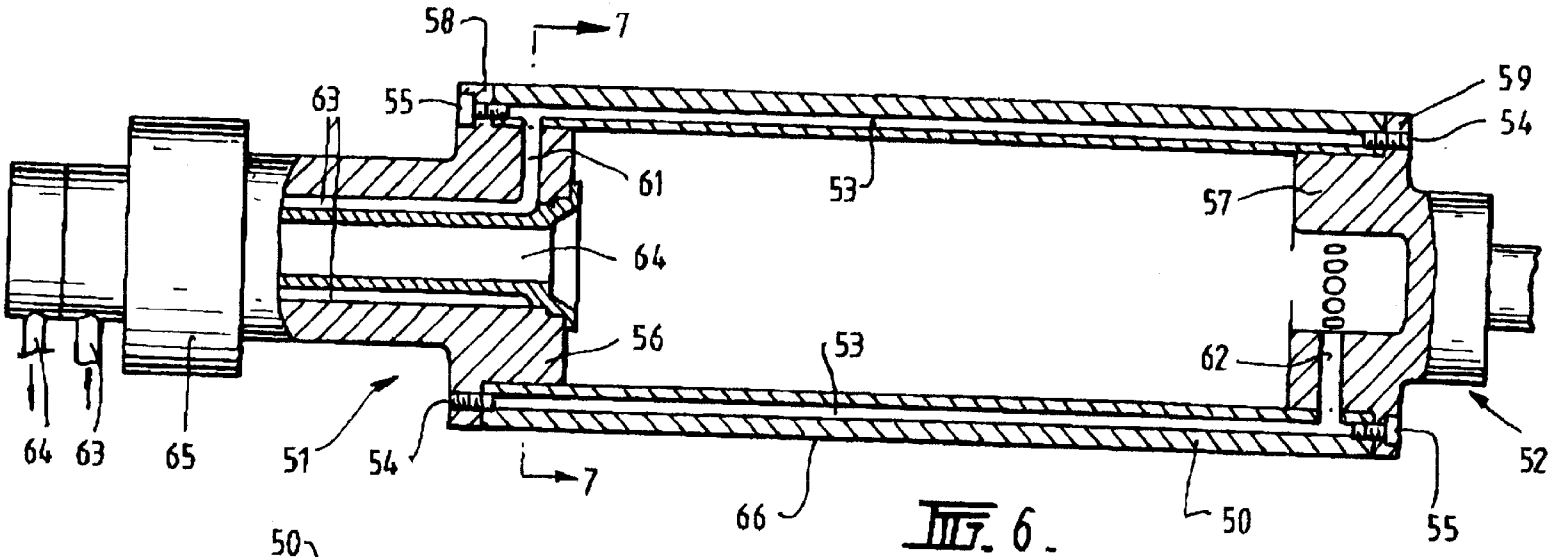
FIG. 6 illustrates an alternative pinch roll assembly in accordance with an embodiment of the invention.
Figure 7:
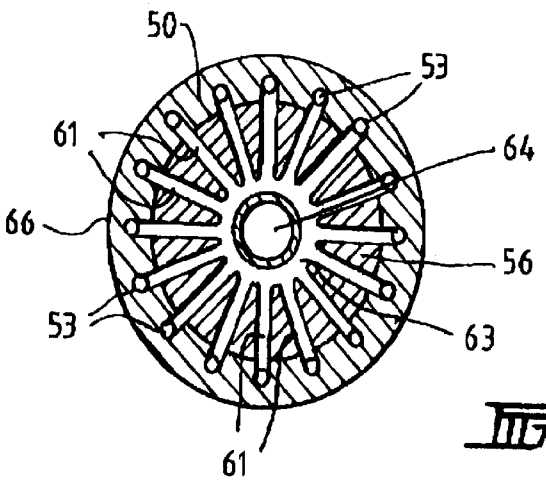
FIG. 7 is a transverse cross-section on the line 7—7 through the pinch roll assembly of FIG. 6.
Figure 8:
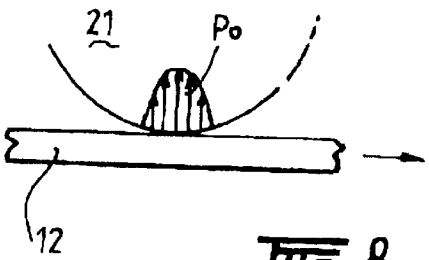
FIG. 8 diagrammatically illustrates the pressure distribution applied to a pinch roll assembly of an embodiment of the invention during operation.

FIGS. 6 and 7 illustrate an alternative embodiment of a pinch roll assembly in accordance with the invention. In this embodiment there is no central arbour. The pinch roll is formed by a cylindrical tube 50 of copper or copper alloy which is mounted between a pair of stainless steel stub shafts 51 and 52. The stub shafts 51 and 52 and the tube 50 are fixed together in a coaxial relationship to form the pinch roll. Tube 50 is provided with a series of longitudinal water flow passages 53 formed by drilling long holes through the cylindrical tube 50 from one end to the other, the ends of the holes subsequently being closed by end plugs 54 and stub shaft fixing screws 55. The stub shafts 51 and 52 have end formations 56 and 57, which fit snugly within the ends of the roll tube 50 and include circumferential flanges 58 and 59 that abut the two ends of the tube 50. The stub shafts 51 and 52 are fixed to the ends of the tube 50 by the fixing screws 55 extending through holes in the flanges and into screw-tapped ends of some of the longitudinal holes defining the water flow passages 53. The ends of the remaining holes that are not screw-tapped are closed by the screw plugs 54.

In the construction illustrated in FIGS. 6 and 7, cooling water flows to and from the water flow passages 53 in tube 50 via radial passages 61 and 62 formed in the inner end formations 56 and 57 of the stub shafts 51 and 52. The radical passages 61 land 62 are connected with inlet and outlet passages 63 and 64 and rotary water coupling 65. The return water flows from passages 62 back through the interior of tube 50 to the outlet passage 64.

The roll construction illustrated in FIGS. 6 and 7 allows very effective cooling of the cylindrical tube 50, and dramatically reduces the incidence of hot spots in the external peripheral roll surface 66 of the pinch roll and in turn dramatically reduces the incidence of imprint defects in the surface of the strip 12.

The importance of having the external peripheral roll surface 66 formed by a tube 50 of copper or copper alloy is demonstrated by Table 1. Table 1 sets out for comparison the results of calculations of surface temperatures at bulged regions or contact points on the external peripheral roll surface 66 of an internally water cooled Cu—Cr alloy roll tube 50 and on an internally water cooled carbon steel roll tube, at various cooling water flow rates.

TABLE 1

Temperature Cooling Surface and External Surface

| Pinch Roll Material | Cooling Water Amount $m^3/hr$ | Cooling Heat Transfer $W/m^2$ K | Cooling Surface Temperature C. | External Surface Temperature C. Contact Point (Maximum) | External Surface Temperature C. Just Before Contact |
|---|---|---|---|---|---|
| Cu—Cr Alloy | 27 | 7080 | 71 | 170 | 98 |
| Cu—Cr Alloy | 54 | 12300 | 57 | 159 | 87 |
| Cu—Cr Alloy | 13.5 | 4060 | 93 | 190 | 120 |
| Carbon Steel | 27 | 7080 | 64 | 383 | 221 |
| Carbon Steel | 54 | 12300 | 54 | 377 | 213 |
| Carbon Steel | 13.5 | 4060 | 80 | 391 | 232 |

As seen in Table 1, the hot spots on a steel pinch roll may reach temperatures of 377 to 391° C. depending on the water flow rate, whereas the corresponding temperatures for a Cu—Cr alloy pinch roll are reduced to 150 to 190° C. Because the Cu—Cr alloy has a thermal conductivity of the order of 6 times greater than that of steel, the temperature rise at any hot spots is limited and heat is dissipated from these regions after the pinch rolls lose contact with the strip during each revolution of the roll. Accordingly, localized bulging on the external roll surface is very much reduced. The combination of the lower temperatures and lower contact pressures at these regions significantly reduces the tendency for scale to smear and stick to the external roll surface so as to generate imprint defects.

The formation of imprints can be further reduced by use of pinch rolls of abnormally large diameter to control the maximum pressure applied to the strip. Sufficient force must be applied to the pinch rolls to cause them to grip the strip firmly and to feed it forwardly. The pressure exerted on the strip is thus dependent on the area of contact between the pinch rolls and the strip, and will decrease with increasing diameter of the pinch roll FIG. 5 diagrammatically illustrates the conditions which apply at the contact between a pinch roll and the strip. With reference to this figure, the maximum pressure applied to the strip by the pinch rolls will be determined by the equation:

$$P_o = \sqrt{\frac{1}{\pi}\frac{q}{R}\frac{1}{\left(\frac{1-v_1^2}{E_1}+\frac{1-v_2^2}{E_2}\right)}} < \sigma_y \tag{2}$$

wherein q: Load per unit width

R: Pinch roll radius $v_1$, $v_2$: Poisson's ratio of roll and strip $E_1$, $E_2$: Young's modulus of roll and strip $\sigma_y$: Minimum yield stress Accordingly, the diameter of the external peripheral surface of the pinch roll may satisfy the equation (1) stated earlier in this specification.

We have determined that when feeding steel strip produced by a twin roll caster it is desirable to maintain a maximum pressure of 20 MPa or less and that this will generally require a pinch roll diameter of 300 mm or more. Typically, if applying a pinch roll force of 100 KN while maintaining a maximum pressure of 20 MPa, the pinch roll diameter should be selected as 530 mm.

What is claimed is:

1. In an apparatus for continuously casting metal strip comprising a pair of casting rolls fanning a nip between them, a metal delivery means for delivery of molten metal into the nip between the casting rolls to form a casting pool of molten metal supported an the casting roll surfaces immediately above the nip, and roll drive means to drive the casting rolls in counter rotational directions to produce a solidified strip of metal delivered downwardly from the nip, and a pinch roll assembly being disposed generally to one side of the caster to receive strip from the cast and feed it away from the caster, the improvement of a pinch roll assembly having pinch rolls each comprised of:

a pair of end support shafts;

a cylindrical tube of copper or copper alloy extending between the support shafts to provide an external peripheral roll surface said external peripheral surface having a diameter of at least 300 mm and yet capable off firmly gripping the strip to feed the strip forward; and cooling water passages formed internally of the pinch roll to cool the cylindrical tube by flow of cooling water through the passages.

2. In the pinch roll assembly as claimed in claim 1 wherein the end shafts are part of a cylindrical arbour to which the copper or copper alloy tube is fitted as an external sleeve.

3. In the pinch roll assembly as claimed in claim 2, wherein the water flow passages are confined to the cylindrical arbour.

4. In the pinch roll assembly as claimed in claim 3, wherein the cooling water passages include longitudinal passages in the cylindrical arbour spaced circumferentially around the arbour adjacent the sleeve.

5. In the pinch roll assembly as claimed in claim 1, wherein the roll is of an arbourless construction in which the end shafts have end formations connected to respective ends of the tube.

6. In the pinch roll assembly as claimed in claim 5, wherein the water flow passages deliver cooling water to the interior of the tube.

7. In the pinch roll assembly as claimed in claim 5, wherein the water flow passages include passages extending longitudinally through the tube.

8. In the pinch roll assembly as claimed in claim 1, wherein the diameter of the external peripheral surface of the pinch roll is at least 500 mm.

9. In the pinch roll assembly as claimed in claim 1, wherein the diameter of the external surface of the roll satisfies the following equation:

$$D > 2\sigma_y^{-2} \cdot q \frac{1}{\pi\left(\frac{1-v_1^2}{E_1} + \frac{1-v_2^2}{E_2}\right)}$$

where q: Load per unit width

D: Pinch roll diameter $v_1 v_2$: Poisson's ratio of roll and strip $E_1 E_2$: Young's modulus of roll and strip $\sigma_y$: Minimum yield stress.

10. A pinch roll as claimed in claim 1, wherein the end shafts are part of a central roll body including a cylindrical arbour to which the copper or copper alloy tube is fitted as an external sleeve.

11. A pinch roll as claimed in claim 1, wherein the water flow passages are confined to the cylindrical arbour.

12. A pinch roll as claimed in claim 10, wherein the cooling water passages include longitudinal passages in the roll body spaced circumferentially around the cylindrical adjacent the sleeve.

13. A pinch roll as claimed in claim 1, wherein the water flow passages include passages extending longitudinally through the tube.

* * * * *